United States Patent [19]

Gerhardsson

[11] Patent Number: 4,930,818

[45] Date of Patent: Jun. 5, 1990

[54] COMBINED CLOSING AND AIRING FURNITURE FOR A DOOR

[75] Inventor: Sven L. Gerhardsson, Motala, Sweden

[73] Assignee: Aktiebolaget Electrolux, Stockholm, Sweden

[21] Appl. No.: 331,591

[22] Filed: Mar. 30, 1989

[30] Foreign Application Priority Data

Apr. 20, 1988 [SE] Sweden ..... 8801444

[51] Int. Cl.[5] ..... E05C 17/10

[52] U.S. Cl. ..... 292/29; 292/DIG. 30; 292/DIG. 44; 292/DIG. 71; 292/101; 292/262; 292/128

[58] Field of Search ..... 292/262, 263, 95, 96, 292/101, 114, 8, 24, 29, 25, 31, 121, 128, DIG. 30, DIG. 71, DIG. 14, DIG. 44

[56] References Cited

U.S. PATENT DOCUMENTS

| | | | |
|---|---|---|---|
| 1,071,802 | 9/1913 | Schlatz . | |
| 1,595,402 | 8/1926 | Iler | 292/101 |
| 2,187,941 | 1/1940 | King | 292/262 |
| 2,322,769 | 6/1943 | Norberg | 292/DIG. 30 X |
| 2,793,061 | 4/1957 | Dall | 292/24 X |
| 3,126,219 | 3/1964 | Engesser et al. | 292/262 |
| 3,161,923 | 12/1964 | Crain | 292/128 |
| 3,621,684 | 11/1971 | Horvay et al. | 292/87 X |
| 4,317,516 | 3/1982 | Palmer-Ball, Sr. | 292/DIG. 71 X |
| 4,452,475 | 6/1984 | Bloch et al. | 292/31 |
| 4,824,153 | 4/1987 | Dugan | 292/262 |

FOREIGN PATENT DOCUMENTS 34812 9/1923 Sweden .

*Primary Examiner*—Eric K. Nicholson

*Attorney, Agent, or Firm*—Pearne, Gordon, McCoy & Granger

[57] ABSTRACT

A combined closing and airing fixture or latch for a door (10) of a refrigerator cabinet comprises a handle (12) which can keep the door closed by means of a hook. An element (20) is arranged on the handle (12), which element is adjustable relative to the handle so that the element (20) can keep the door (10) ajar in an airing position by means of a hook (22).

1 Claim, 1 Drawing Sheet

COMBINED CLOSING AND AIRING FURNITURE FOR A DOOR

The invention relates to a closing fixture or latch for a door comprising a handle which is arranged on the door, turnable around an axis, and provided with a first hook engaging a second hook to keep the door in a closed position. A spring keeps the handle wth the first hook in engagement with the second hook, the first hook being arranged to disengage from the second hook by the handle with the first hook being turned around the axis against the action of the spring.

SUMMARY OF THE INVENTION

The object of the invention is to bring about an arrangement which can keep the door ajar in an airing position.

This object is attained by an element arranged on the handle and provided with a third hook and being displaceable to two different positions on the handle. the third hook in one of said positions coincides with the first hook and, together with the first hook, engages the second hook to keep the door in the closed position and, in the second of said positions, the third hook protrudes outside the first hook and alone engages the second hook to keep the door in an airing position.

By this the closing fixture or latch will be modified by simple means so that it also can keep the door in an airing position.

BRIEF DESCRIPTION OF THE DRAWINGS

An embodiment of a fixture or latch according to the invention is described in the enclosed drawings, on which

DESCRIPTION OF THE PREFERRED EMBODIMENT

Figure 1:
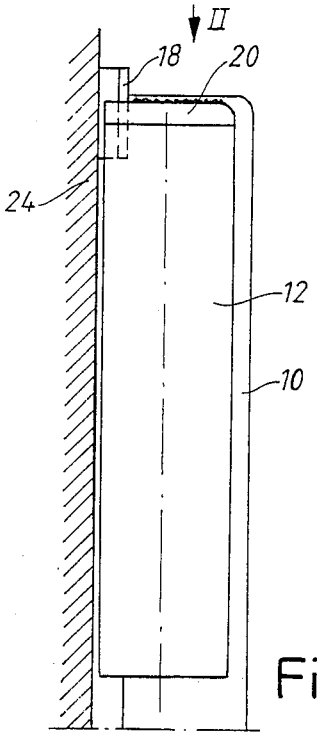
FIG. 1 shows a view towards a vertical edge of a closed door.
Figure 3:
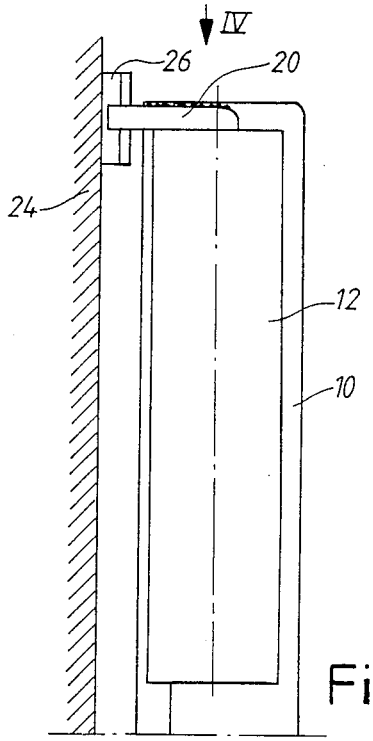
FIG. 3 shows in the same view as FIG. 1 the door ajar in an airing position.
Figure 2:
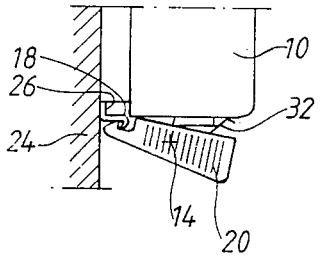
FIG. 2 shows a view according to the marking II in FIG. 1.

A door 10 is turnable on a refrigerator cabinet 24 around a vertical axis, not shown, at one edge of the door. At the opposite edge of the door a handle 12 is arranged turnable around a vertical axis 14. The inner end of the handle is provided with a hook 16 arranged to engage a hook 18 of a holder 26 which is fastened to the cabinet to keep the door 10 closed (FIGS. 1 and 2). The door is opened by the handle 12 being turned around the axis 14 against the action of a spring 32, so that the hook 16 is disengaged from the hook 18.

Figure 4:
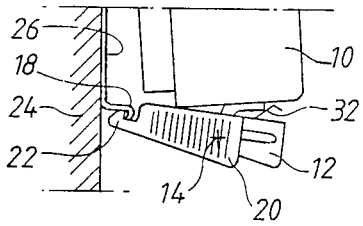
FIG. 4 shows a view according to the marking IV in FIG. 3.
Figure 5:
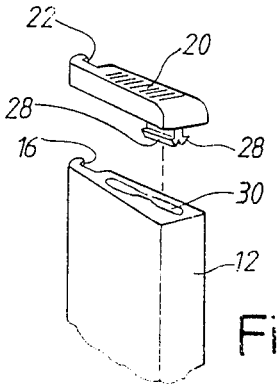
FIG. 5 shows a perspective view of a handle with an element for keeping the door in an airing position.

The handle 12 is provided with an element 20 which is adjustable relative to the handle 12 into two different positions. In the one position (FIG. 2) the "profile" of the element 20 coincides with that of the handle 12. In the other position (FIG. 4) the element 20 protrudes from the handle 12 and engages the hook 18 by a hook 22, so that the door is kept in an airing position. The element 20 is made in one piece together with springing protrusions 28. The protrusions 28 protrude downwards into a groove 30 of the handle 12. The groove 30 is shaped so that the element 20 can be displaced between the positions shown in FIGS. 2 and 4 and be kept locked in these positions by the springing protrusions 28.

The fixture or latch is suitable for use with a refrigerator cabinet in a caravan, where the fixture or latch prevents the door of the cabinet from flying open by the movement of the caravan when the door is closed as well as when it is located in airing position.

I claim:

1. In a closing fixture or latch for a door (10) comprising a handle (12) which is arranged on the door turnable around an axis (14), said handle being provided with a first hook (16) engaging a second hook (18) to keep the door in a closed position, a spring (32)

keeps the handle (12) with the first hook (16) in engagement with the second hook (18), the first hook (16) being arranged to disengage from the second hook (18) by the handle (12) with the first hook (16) being turned around the axis (14) against the action of the spring (32), the improvement wherein an element (20) arranged on the handle (12) and provided with a third hook (22) and being displaceable to two different positions on the handle, the third hook (22) in one of said positions coincides with the first hook (16) and, together with the first hook (16), engages the second hook (18) to keep the door in the closed position and, in the second of said positions, the third hook (22) protrudes outside the first hook (16) and alone engages the second hook (18) to keep the door in an airing position.

* * * * *

UNITED STATES PATENT AND TRADEMARK OFFICE

CERTIFICATE OF CORRECTION

PATENT NO. : 4,930,818

DATED : June 5, 1990

INVENTOR(S) : Sven L. Gerhardsson

It is certified that error appears in the above-identified patent and that said Letters Patent is hereby corrected as shown below:

In the Title, delete "FURNITURE" and insert --LATCH--.

Column 1, line 2, delete "FURNITURE" and insert --LATCH--.

Column 1, between lines 3 and 4, insert --BACKGROUND OF THE INVENTION--.

Column 1, line 21, delete "the" (second occurrence) and insert --The--.

Signed and Sealed this

Eighteenth Day of June, 1991

*Attest:*

*Attesting Officer*

HARRY F. MANBECK, JR.

*Commissioner of Patents and Trademarks*